US006702549B2

(12) United States Patent
Tiemann

(10) Patent No.: US 6,702,549 B2
(45) Date of Patent: Mar. 9, 2004

(54) TURBINE INSTALLATION

(75) Inventor: Peter Tiemann, deceased, late of Witten (DE), by Iris Oltmanns, legal representative

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/220,200

(22) PCT Filed: Feb. 23, 2001

(86) PCT No.: PCT/EP01/02094

§ 371 (c)(1),
(2), (4) Date: Aug. 29, 2002

(87) PCT Pub. No.: WO01/65073

PCT Pub. Date: Sep. 7, 2001

(65) Prior Publication Data

US 2003/0012643 A1 Jan. 16, 2003

(30) Foreign Application Priority Data

Mar. 2, 2000 (EP) ..... 00104346

(51) Int. Cl.[7] ..... F01D 11/00

(52) U.S. Cl. ..... 415/135; 415/138; 415/139; 415/191; 60/756; 60/757; 60/800; 277/630; 277/637; 277/647; 277/649

(58) Field of Search ..... 415/135, 136, 415/138, 139, 173.3, 174.2, 191; 277/628, 630, 637, 644, 647, 649, 650; 60/800, 755–757

(56) References Cited

U.S. PATENT DOCUMENTS

| | | | | | |
|---|---|---|---|---|---|
| 2,544,538 | A | * | 3/1951 | Mahken et al. | 60/800 |
| 2,991,045 | A | | 7/1961 | Tassoni | |
| 2,999,631 | A | | 9/1961 | Wollmershauser | |
| 3,728,041 | A | * | 4/1973 | Bertelson | 415/191 |
| 4,602,795 | A | * | 7/1986 | Lillibridge | 277/644 |
| 5,088,888 | A | * | 2/1992 | Bobo | 415/138 |
| 5,158,305 | A | * | 10/1992 | Halling | 277/647 |
| 5,669,612 | A | * | 9/1997 | Nicholson | 277/626 |
| 5,716,052 | A | * | 2/1998 | Swensen et al. | 277/647 |
| 5,735,671 | A | | 4/1998 | Brauer et al. | |
| 6,203,025 | B1 | * | 3/2001 | Hayton | 277/644 |
| 6,237,921 | B1 | * | 5/2001 | Liotta et al. | 277/630 |

FOREIGN PATENT DOCUMENTS

| | | |
|---|---|---|
| EP | 0 616 112 | 9/1994 |
| WO | 98/53 228 | 11/1998 |

* cited by examiner

*Primary Examiner*—Christopher Verdier
(74) *Attorney, Agent, or Firm*—Harness, Dickey & Pierce, P.L.C.

(57) ABSTRACT

A turbine installation, especially a gas turbine installation, includes foot plates of the guide blades of adjacent turbine stages being interconnected with a clip-type sealing element on their rear sides facing away from the gas area. This provides a simple seal between adjacent foot plates which is effective regardless of the thermal expansion of the foot plates. The clip-type sealing element is also suitable for sealing the tiles of a combustor of the turbine installation together.

23 Claims, 4 Drawing Sheets

TURBINE INSTALLATION

This application is the national phase under 35 U.S.C. §371 of PCT International Application No. PCT/EP01/02094 which has an International filing date of Feb. 23, 2001, which designed the United States of America and which claims priority on European Patent Application number EP 00104346.2 filed Mar. 2, 2000, the entire contents of which are hereby incorporated herein by reference.

FIELD OF THE INVENTION

The invention generally relates to a turbine installation, in particular a gas turbine installation.

By a gas turbine installation is meant hereafter an installation which includes a combustion chamber and a turbine located downstream of the combustion chamber and designated as a gas turbine.

BACKGROUND OF THE INVENTION

In a combustion chamber of a gas turbine installation, a fuel gas is burnt in a gas space, and the hot gas generated at the same time is supplied to the turbine and flows through the latter. The flow path of the hot gas through the turbine is likewise designated hereafter as the gas space. The turbine has stationary guide vanes, which extend radially from outside into the gas space, and moving blades which are mounted on a shaft designated as a rotor and which extend radially outward from the rotor. As seen in the longitudinal direction of the turbine, the guide vanes and the moving blades engage one into the other in a tooth-like manner.

The turbine, as a rule, has a plurality of turbine stages, with a guide vane ring being arranged in each stage. Thus, a plurality of the guide vanes are arranged next to one another in the circumferential direction of the turbine. The individual guide vane rings are arranged successively in the axial direction.

Both at the combustion chamber and at the turbine, the gas space is conventionally lined with plate elements. At the combustion chamber, these are tiles, and at the turbine, the plate elements are formed by what are known as foot plates of the individual guide vanes.

The gas region of the combustion chamber and of the turbine is to be as leak-tight as possible. The aim is therefore to have insignificant leakage losses between the individual plate elements. In particular, leakage losses between two turbine stages are to be prevented.

As a result of the high temperature spans in the gas space, there is the problem that a seal has to absorb and bridge expansions of the individual plate elements, without the seal being appreciably impaired. This problem is aggravated by the fact that neither the tiles nor the foot plates of the guide vanes are fastened at their edge regions to adjacent plate elements, so that the plate edges are to a greater or lesser extent free and undergo bending as a result of thermal expansion. The tiles, for example, are, as a rule, fastened in their center and bend approximately spherically under thermal load. A seal must therefore allow both axial and radial movability, also because the combustion chamber and the turbine are designed conically in the axial direction.

In a conventional seal, the foot plates are provided in the region of the turbine with a groove on their end face, a sealing sheet being inserted into the grooves of two foot plates of guide vanes of adjacent turbine stages. Where the end-face grooves are concerned, the axial and radial movability of the foot plates is achieved in that the grooves have oblique side walls. However, grooves of this kind are highly complicated in production terms. Moreover, a seal of this kind is relatively leaky, since a varyingly rapid thermal expansion behavior of the foot plates and of what is known as the turbine guide vane carrier to which they are fastened must be taken into account.

To be precise, when the turbine is started up, the foot plates expand more rapidly, so that a leakage gap between the foot plates is initially closed. The leakage gap opens again when the turbine guide vane carrier has expanded according to the temperature.

With regard to the tiles in the combustion chamber, there is additionally the problem that, because they bend spherically, such a sealing sheet is sometimes subjected to shearing load until it fails.

SUMMARY OF THE INVENTION

An object on which an embodiment of the invention is based, is to make it possible to have a seal which overcomes at least one of the disadvantages described. The object may be achieved, according to an embodiment of the invention, by a turbine installation, in particular a gas turbine installation, with a gas space which is outwardly delimited via plate elements contiguous to one another. A sealing element is assigned in each case to plate elements adjacent to one another and connecting these to one another in a staple-like manner on their rear sides facing away from the gas space.

An advantage is seen in the staple-like configuration of the sealing element. The sealing element thus spans the two plate elements. Under thermal expansions, the sealing element follows the plate elements, without opening up a gap. The seal produced by the sealing element is therefore largely unaffected by thermal expansions.

In order to ensure as good a seal as possible, even under all-round thermal expansions, the sealing element preferably allows a movability of the plate elements both in the axial and in the radial direction. The sealing element may therefore be designed, in particular, to be elastic both in the axial and in the radial direction. By axial direction, what is meant is an expansion in the longitudinal direction of the turbine installation and by radial direction, it means an expansion perpendicular to the longitudinal axis.

Preferably, the sealing element has two limbs which engage in each case into a groove of plate elements adjacent to one another. This makes it possible to have a fastening of the sealing elements which is simple to implement in production terms.

Preferably, the groove extends from the rear side of the respective plate element into the latter, essentially radially. The limbs therefore project radially outward from the grooves. This configuration of the groove allows simple production and, in particular, high accuracy, for example by grinding or erosion. An advantage of the arrangement on the rear side is to be seen in that the groove does not have to be of a special shape with regard to the problem of thermal expansions. The groove and sealing element can therefore be adapted very accurately to one another, so that very small leakage gaps are achieved.

In order to make it possible to have a simple procedure for mounting the plate elements in the turbine installation, the sealing element is preferably of multipart construction.

In this case, preferably, the limbs of the multipart sealing element overlap one another over a common circumferential length. This circumferential length is in this case dimensioned sufficiently large essentially to avoid leakages.

In a preferred embodiment, the sealing element is of U-shaped design, this being simple to implement both in production terms and in assembly terms.

In order to achieve a high expandability of the sealing element, the latter has a wavy structure in the manner of a concertina in order to absorb expansions.

Expediently, the sealing element has this wavy structure in a plurality of directions, so that it can absorb expansions in different directions. In particular, the sealing element has a configuration in the form of a double S.

In a preferred embodiment, the sealing element is arranged between adjacent tiles of a combustion chamber. Reliable sealing between the tiles is consequently achieved, even when these bend spherically as a result of thermal load.

According to a particularly preferred embodiment, the sealing element is arranged between the foot plates of adjacent guide vanes of a turbine, specifically, in particular, between the foot plates of guide vanes of adjacent turbine stages.

The individual foot plates are accordingly connected to one another in the axial or the longitudinal direction of the turbine via staple-like sealing elements.

In order to achieve simple mounting of the plate elements, in particular of the foot plates, and at the same time good sealing of the plate elements both in the circumferential direction and in the axial direction between adjacent turbine stages, preferably, the staple-like sealing element described is provided for sealing in the axial direction and a further sealing element is provided for sealing in the circumferential direction. Depending on the direction, therefore, and in particular for assembly reasons, differently designed sealing elements are used.

The further sealing element in this case preferably has a reception region, into which the plate elements extend. In particular, the sealing element is designed with an H-shaped cross section. The fundamental idea of this configuration is to be seen in the reversal of a conventional sealing principle, in which a sealing sheet is introduced into corresponding end-face grooves of the foot plates. To be precise, this, as a rule, necessitates a reinforcement of the edge of the foot plates in the groove region. This presents problems with regard to an effective cooling of the foot plates, since, on account of the different material thicknesses, a uniform cooling can be implemented only with difficulty and thermal stresses may occur. In this case, in a reversal of this sealing principle, the sealing sheet is not inserted into the foot plates but, instead, the foot plates are introduced into the sealing element. This avoids the need for a reinforcement of the edge region of the foot plate. Coolability is thus simplified and the foot plate is cooled homogeneously in all regions, so that no thermal stresses occur.

BRIEF DESCRIPTION OF THE DRAWINGS

Exemplary embodiments of the invention are explained in more detail hereafter with reference to the drawings, in which, in each case in a roughly simplified illustration.

DETAILED DESCRIPTION OF THE PREFERRED EMBODIMENTS

Figure 1:
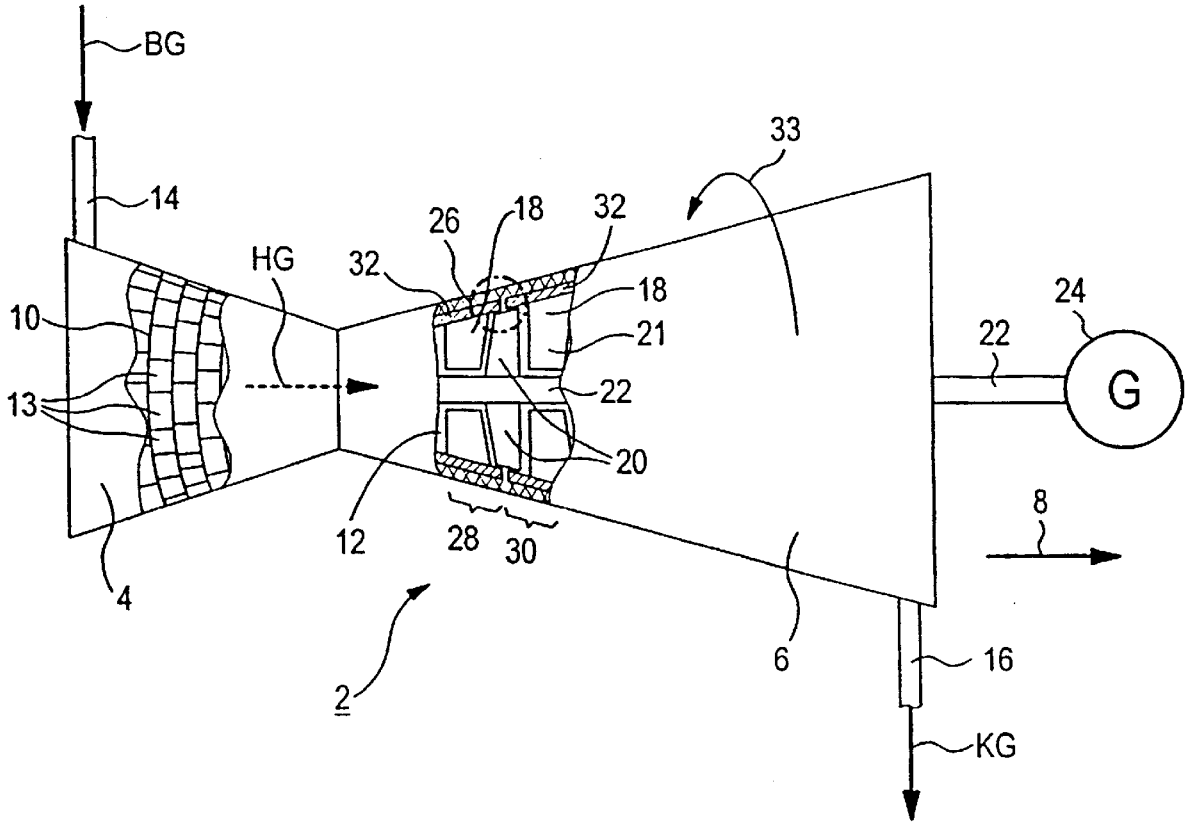
FIG. 1 shows a turbine installation with combustion chamber and turbine.

According to FIG. 1, a turbine installation 2, in particular a gas turbine installation of a turbo set for a power station for energy generation, comprises a combustion chamber 4 and a turbine 6 which is arranged downstream of the combustion chamber 4 in the longitudinal or axial direction 8 of the turbine installation 2. Both the combustion chamber 4 and the turbine 6 are illustrated, cut away, in a part region. It is consequently possible to look into the gas space 10 of the combustion chamber 4 and into the gas space 12 of the turbine 6.

During operation, the combustion chamber 4 is supplied via a gas supply 14 with a fuel gas BG which is burnt in the gas space 10 of the combustion chamber 4 and forms a hot gas HG. The gas space 10 is lined with a multiplicity of tiles 13 designed as plate elements. The hot gas HG flows through the turbine 6 and leaves the latter as cold gas KG via a gas discharge line 16. The hot gas HG is guided in the turbine 6 via guide vanes 18 and moving blades 20. In this case, a shaft 22, on which the moving blades 20 are arranged, is driven. The shaft 22 is connected to a generator 24.

The moving blades 20 extend radially outward from the shaft 22. The guide vanes 18 have a foot plate 32 and a vane leaf 21 fastened to the latter. The guide vanes 18 are in each case fastened outwardly to the turbine 6 on what is known as a guide vane carrier 26 via their foot plates 32 and extend radially into the gas space 12. As seen in the longitudinal direction 8, the guide vanes 18 and the moving blades 20 engage one into the other in a tooth-like manner. A plurality of moving blades 20 and of guide vanes 18 are in this case combined to form a ring, each guide vane ring representing a turbine stage. In the exemplary embodiment of FIG. 1, the second turbine stage 28 and the third turbine stage 30 are illustrated by way of example.

The foot plates 32 of the individual guide vanes 18, like the tiles 13, are designed as plate elements which are contiguous to one another both in the axial direction 8 and in the circumferential direction 33 of the turbine 6 and which delimit the gas space 12. The location marked by a circle in FIG. 1 is illustrated, enlarged, in FIGS. 2 to 4. The seal, described with regard to these figures, between two foot plates 32 which, in particular, are arranged next to one another in the longitudinal direction 8 can also be transferred accordingly to form a seal for the tiles 13 of the combustion chamber 4.

Figure 2:
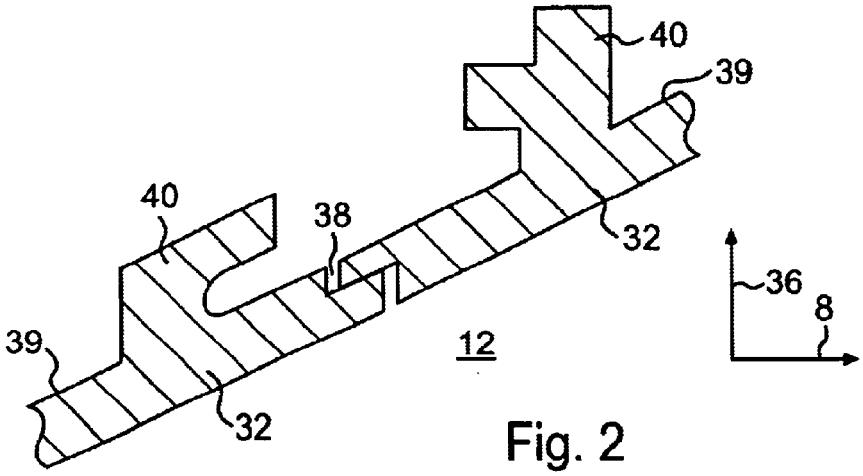
Fig. 2 PRIOR ART
FIGS. 2 and 3 show different conventional seal variants.

According to FIG. 2, in a conventional variant illustrated here, sealing is carried out, without a special sealing element, solely by virtue of an overlap of foot plates 32 adjacent to one another. The two foot plates 32 have a step-shaped design in the overlap region. Under thermal stress and the associated expansion, the two foot plates 32 are displaced relative to one another in a movement superposed in the longitudinal direction 8 and in the radial direction 36. The leakage gap 38 formed between the two foot plates 32 varies as a result. The sealing action thus depends decisively on the expansion behavior of the foot plates 32.

Figure 3:
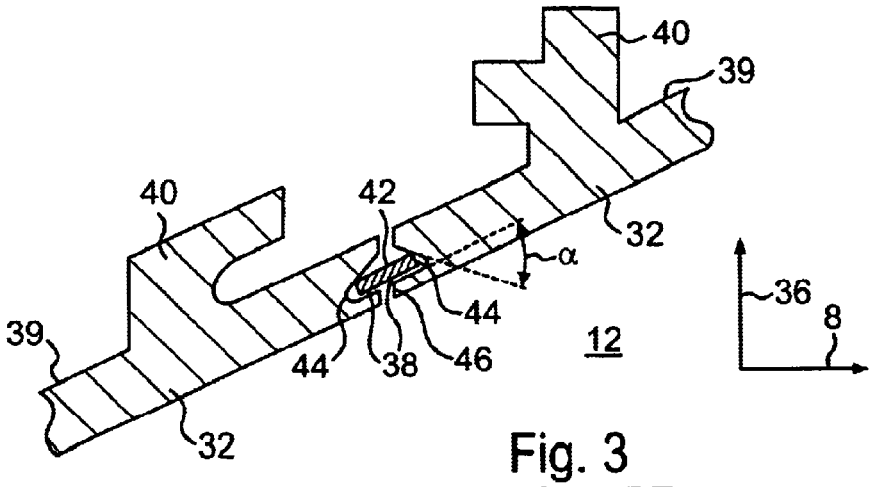
Fig. 3 PRIOR ART
Figure 4:
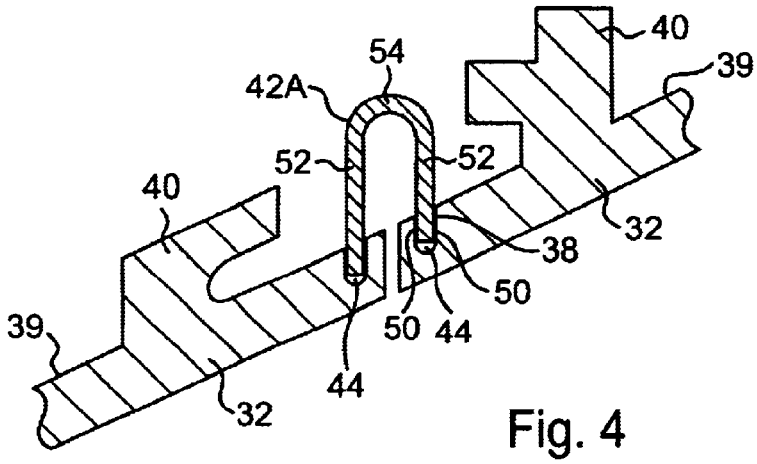
FIG. 4 shows the seal variant according to the invention.

The foot plates 32 according to FIGS. 2 to 4, each have, on their rear side 39 facing away from the gas space 12, a hooking element 40 via which the foot plates 32 are held on the guide vane carrier 26 (cf. FIG. 1). Each foot plate 32 in this case typically has two hooking elements 40 which are configured differently and allow movability both in the axial direction 8 and in the radial direction 36.

According to FIG. 3, a further conventional sealing arrangement has a sealing sheet 42 which is inserted into grooves 44 in the adjacent foot plates 32. The grooves 44 are in this case worked into the end faces 46 of the foot plates 32. They have an opening angle a of approximately 15°, in order to allow a movability of the foot plates 32 in the radial direction 36. In this embodiment, too, there is formed between the sealing sheet 42 and the foot plates 32 a leakage gap 38 which varies with expansion as a result of the thermal load. This variation is caused, inter alia, by the fact that the foot plates 32 expand more rapidly than the guide vane carrier 36 to which they are fastened.

In particular, the problems of the temperature dependence of the leakage gap 38 do not arise in the novel configuration according to FIG. 4. According to this, grooves 44, which extend essentially radially into the foot plates 32, are worked into the rear side 39 of the two foot plates 32 in the region in which the latter are contiguous to one another. It must be stressed that the grooves 44 according to FIG. 4 have parallel side walls 50, in contrast to those of FIG. 3. This allows a particularly simple production of the grooves 44.

A U-shaped sealing element 42A is introduced with its two limbs 52 into the grooves 44 and, in particular, is fastened. Fastening is carried out, for example, by means of a clamping action or else by welding. The sealing element 42A is produced, in particular, as a sheet-metal element. Its limbs 52 extend outward, essentially in the radial direction, so that the arc 54 connecting the two limbs 52 is at a distance from the rear side 39. This elongate design makes it possible for the sealing element 42A to have an elastic behavior, that is to say it follows the thermal expansions of the foot plates 32. The thermal movability of the foot plates 32 is thus ensured by the bendable or expandable sealing element 42A. Movability is therefore independent of the special configuration of the grooves 44, so that these can be adapted with a highly accurate fit to the limbs 52. Between the limbs 52 and the grooves 44, therefore, no or only a very small leakage gap 38 is formed, which is independent of the thermal stress on the foot plates 32.

Figure 5:
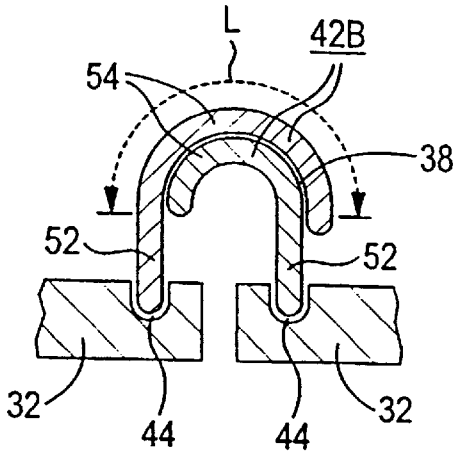
FIGS. 5–7 show different variants of a seal element.
Figure 6:
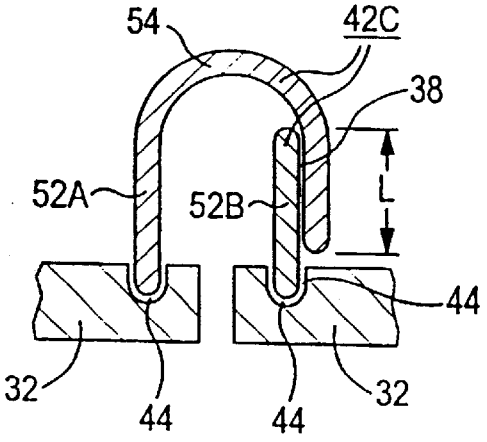
Figure 7:
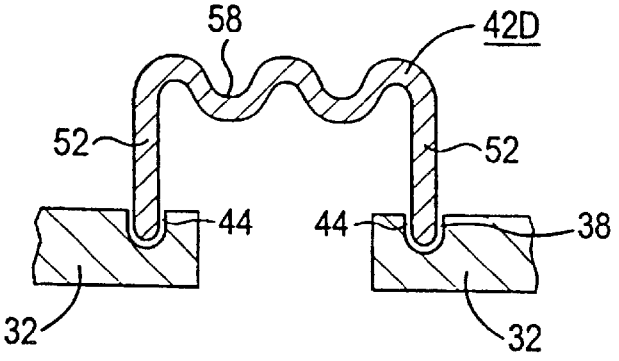

Alternative embodiments of the sealing element 42A are illustrated by way of example in FIGS. 5 to 7. According to FIG. 5, a sealing element 42B is formed from two separate limbs 52 which each have an arc 54 and overlap one another over a circumferential length L. The multipart design of the sealing element B simplifies mounting, since, for example, individual limbs 52 can simply be fastened into the corresponding grooves 44 of the respective foot plates 32, even before the mounting of the guide vanes 18, and the foot plates can subsequently be attached to the guide vane carrier 26. The common circumferential length L selected is in this case as large as possible, in order to keep the leakage gap 38 formed between them small for all thermal and operating states.

In an alternative multipart design of a sealing element 42C according to FIG. 6, only one limb 52A is provided with an arc 54, whereas the second limb 52B is a straight sheet-metal piece. In the multipart sealing elements 42B, 42C it is advantageous if the individual limbs 52 are pressed against one another in the mounted state and, for example, have some spring tension.

According to FIG. 7, a sealing element 42D is provided with a wavy structure 58 which replaces the simply configured arc 54 according to FIGS. 4 to 6. This wavy structure 58 extends preferably in a plurality of directions, in particular in the two directions parallel to the foot plates 32. In addition, the limbs 52, too, may be wavy. The sealing element 42D is thus designed in the manner of a concertina and makes it possible to absorb even high thermal expansions in a plurality of directions, without the leakage gap 38 being enlarged.

The sealing elements 42A to 42D preferably connect the foot plates 32 of guide vanes 18 of adjacent turbine stages 28, 30 for assembly reasons. In order to achieve a good and simply mountable seal even in the circumferential direction 33, a further sealing element 60 is provided for guide vanes 18 of a guide vane ring which are adjacent to one another in the circumferential direction 33.

Figure 8:
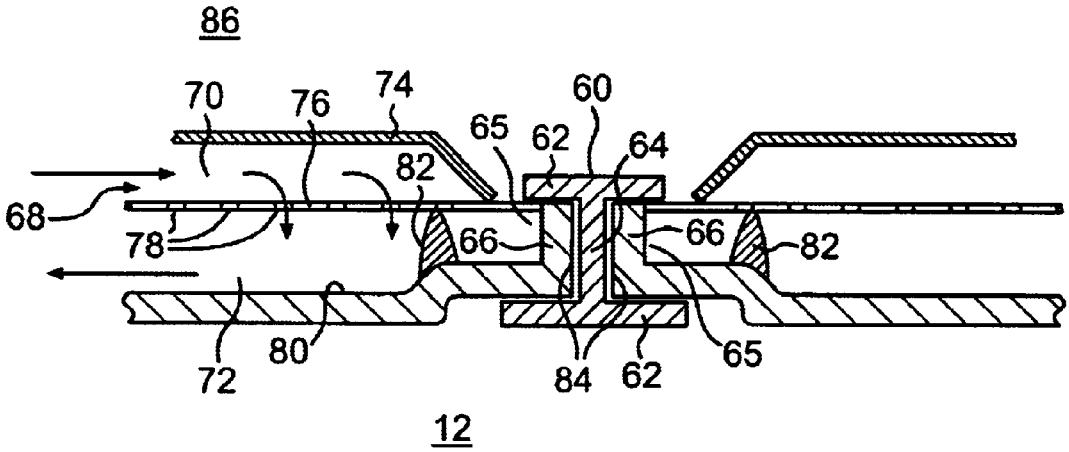
FIG. 8 shows a seal provided, in particular, for plate elements arranged next to one another in the circumferential direction.

According to FIG. 8, the further sealing element 60 is preferably designed with an H-shaped cross section and has two longitudinal limbs 62 which are connected to one another via a transverse limb 64. Between the two longitudinal limbs 62 are formed two reception regions 65 which are separated from the transverse limb 64 and into which the foot plates 32 extend. The side edges 66 of the foot plates 32 are bent away outward from the gas space 12 approximately perpendicularly and fit snugly against the transverse limb 64.

This configuration with the reception regions 65 for the foot plates 32 advantageously makes it possible to have a material thickness which is homogeneous over the entire foot plate 32, so that uniform cooling of the foot plate 32 is ensured and thermal stresses in the foot plate 32 do not occur.

To cool the foot plates 32, in particular, a closed cooling system 68, a detail of which is illustrated in FIG. 8, is provided, with steam as the coolant. This closed cooling system 68 has an inflow duct 70 and a return-flow duct 72. The inflow duct 70 is formed between an outer guide sheet 74 and a baffle sheet 76, which is arranged between the guide sheet 74 and the foot plate 32. The baffle sheet 76 has flow orifices 78 which are designed in the manner of nozzles, so that the coolant supplied via the inflow duct 70 flows over into the return-flow duct 72 along the arrows illustrated. By virtue of the nozzle-like operation of the flow orifices 78, the coolant is guided at high velocity against the rear side 80 of the foot plate 32, so that effective heat transmission between the coolant and the foot plate 32 is implemented.

The baffle sheet 76 is supported against the foot plate 32 and kept at a distance from the latter via supporting elements 82, for example in the form of weld spots or welded webs. The baffle sheet 70 is directly fastened, in particular welded, to the side edge 66 of the foot plate 32 and the guide sheet 68 is fastened to the baffle sheet 70.

A flow path 84 in the form of a leakage gap is formed between the further sealing element 60 and at least one of the foot plates 32, so that, for example, air from the outside space 86 facing away from the gas space 12 can flow via the flow path 84 into the gas space 12 and consequently cools the seal region, that is to say the sealing element 60 and the side edges 66.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the groove extends from the rear side of the respective plate element into the latter.

2. The turbine installation as claimed in claim 1, wherein the sealing element permits movability of the plate elements, both in the axial direction and in the radial direction.

3. The turbine installation as claimed in claim 2, wherein the sealing element is of multipart construction.

4. The turbine installation as claimed in claim 3, wherein the two limbs of the multipart sealing element overlap one another over a common circumferential length.

5. The turbine installation as claimed in claim 2, wherein the sealing element is of U-shaped design.

6. The turbine installation as claimed in claim 2, wherein the sealing element includes a wavy structure in the manner of a concertina, in order to absorb expansions.

7. The turbine installation as claimed in claim 6, wherein the sealing element includes the wavy structure in a plurality of directions.

8. The turbine installation as claimed in claim 2, wherein the sealing element is arranged between foot plates of adjacent guide vanes of a turbine.

9. The turbine installation as claimed in claim 1, wherein the sealing element is of U-shaped design.

10. The turbine installation as claimed in claim 1, wherein the sealing element is arranged between adjacent tiles of a combustion chamber.

11. The turbine installation as claimed in claim 1, wherein the groove extends essentially radially.

12. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the sealing element is of multipart construction.

13. The turbine installation as claimed in claim 12, wherein the two limbs of the multipart sealing element overlap one another over a common circumferential length.

14. The turbine installation of claim 12, wherein the turbine installation is a gas turbine installation.

15. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the sealing element includes a wavy structure in the manner of a concertina, in order to absorb expansions.

16. The turbine installation as claimed in claim 15, wherein the sealing element includes the wavy structure in a plurality of directions.

17. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the sealing element is arranged between foot plates of adjacent guide vanes of a turbine.

18. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the sealing element is arranged between axially adjacent plate elements.

19. The turbine installation as claimed in claim 18, further comprising:

a further sealing element with a reception region, into which the plate elements extend, provided between plate elements adjacent to one another in the circumferential direction.

20. The turbine installation as claimed in claim 18, wherein a further sealing element is provided between foot plates of guide vanes.

21. A turbine installation, comprising:

plate elements, outwardly delimiting a gas space;

a sealing element, including two limbs assigned to plate elements adjacent to one another and connecting these to one another in a staple-like manner on their rear sides facing away from the gas space, wherein the sealing element engages a respective limb into a respective groove, arranged in plate elements adjacent to one another, wherein the sealing element is arranged between foot plates of guide vanes of turbine stages adjacent to one another.

22. The turbine installation as claimed in claim 21, further comprising:

a further sealing element with a reception region, into which the plate elements extend, provided between plate elements adjacent to one another in the circumferential direction.

23. The turbine installation as claimed in claim 22, wherein the further sealing element is provided between foot plates of guide vanes.

* * * * *